United States Patent [19]

Mocha

[11] 3,991,661

[45] Nov. 16, 1976

[54] THREE POSITION FLUID POWERED ACTUATOR

[75] Inventor: William J. Mocha, Tulsa, Okla.

[73] Assignee: Air Power Systems Company, Inc., Tulsa, Okla.

[22] Filed: July 21, 1975

[21] Appl. No.: 597,516

[52] U.S. Cl. ..... 92/131; 92/13; 92/164

[51] Int. Cl.[2] ..... F01B 31/00

[58] Field of Search ..... 92/131, 13, 164

[56] References Cited

UNITED STATES PATENTS

| | | | |
|---|---|---|---|
| 2,092,580 | 9/1937 | Kelley | 92/131 |
| 3,168,854 | 2/1965 | Neilson | 92/131 |
| 3,537,355 | 11/1970 | Bliss | 92/131 |

FOREIGN PATENTS OR APPLICATIONS

| | | | |
|---|---|---|---|
| 1,458,159 | 8/1970 | Germany | 92/131 |
| 171,919 | 12/1921 | United Kingdom | 92/131 |

*Primary Examiner*—Paul E. Maslousky
*Attorney, Agent, or Firm*—Head, Johnson & Chafin

[57] ABSTRACT

A three position fluid powered actuator including a cylinder having a first end, a second end and an intermediate plate, the first end and intermediate plate having coaxial openings therein, a piston reciprocally positioned within the cylinder between the second end and the intermediate plate, a piston rod affixed to the cylinder and sealably and slidably received in the opening in said first end. The piston rod has a reduced diameter portion between said cylinder first end and the intermediate plate. Positioned on the reduced diameter portion of the piston rod is a pair of spring followers each abutting against the shoulder formed at each end of the intermediate portion and between the followers is a compressed spring. When fluid pressure is applied to the cylinder to either side of the piston, the piston is moved, compressing the spring. When the fluid pressure is removed, the spring returns the piston to the intermediate position. The device thereby may be termed a "three position" actuator since it can be moved to two different positions by the application of fluid pressure and automatically is moved back to an intermediate position by the positive action of the spring when fluid pressure is removed.

1 Claim, 4 Drawing Figures

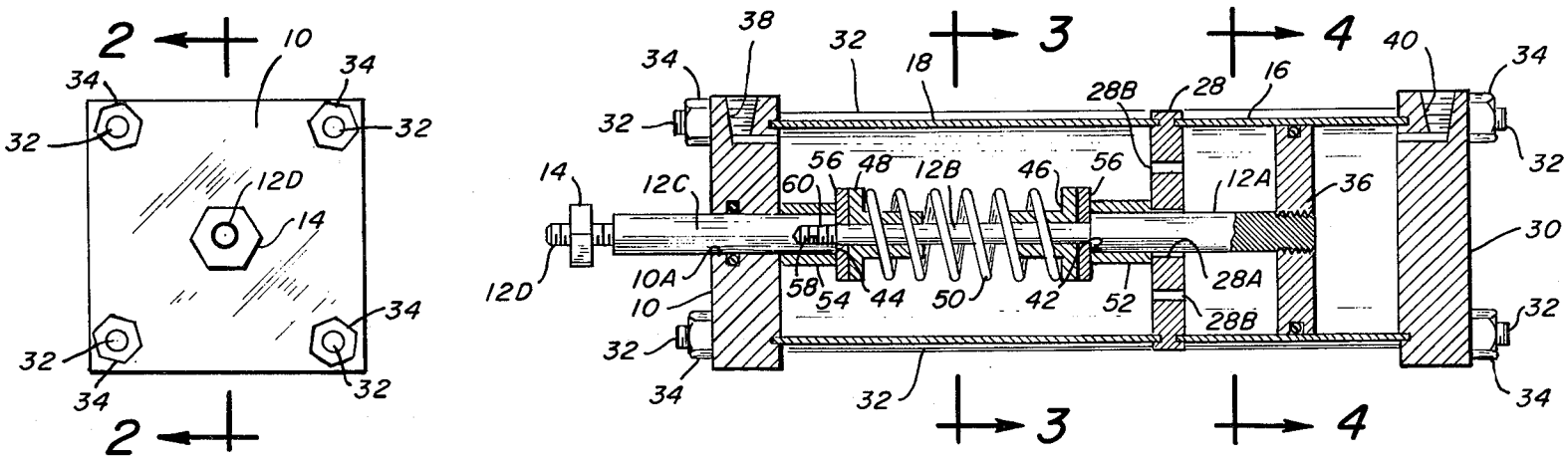
FIG. 2
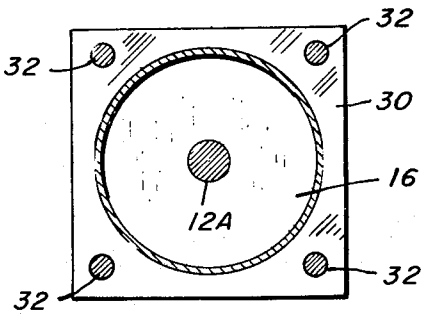
FIG. 4
FIG. 1
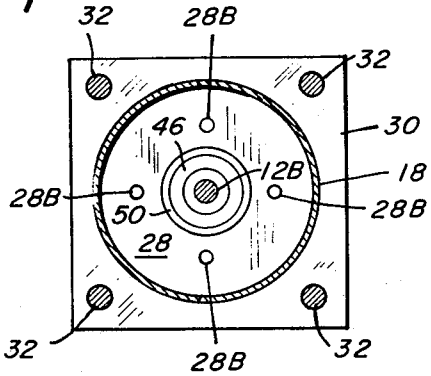
FIG. 3

THREE POSITION FLUID POWERED ACTUATOR

BACKGROUND AND OBJECTS OF THE INVENTION

Fluid actuators, either hydraulic or pneumatic, are frequently employed for moving components of machinery from one position to another. Normally actuators are of the type in which fluid pressure is applied to move a piston in a cylinder. Two position actuators are common wherein fluid pressure may be applied to either end of the cylinder to positively move a piston in one direction or the other.

The present invention is directed towards a type of actuator having three positions, that is, wherein fluid pressure may be applied to move a piston in a cylinder in either direction relative to the cylinder and including an intermediate position in which the piston is normally retained when not actuated by fluid pressure. Three position actuators are known in industry, however, the three position actuator described herein has the characteristic of positively returning the piston to a preselected intermediate position when fluid pressure is removed.

Important characteristics of the three position actuator of this invention are: (a) variable stroke lengths from the intermediate position may be selected; and (b) no fluid pressure is required to retain the piston in the intermediate position.

It is therefore an object of this invention to provide an improved fluid powered actuator. More particularly, an object of the invention is to provide a three position fluid powered actuator including means of positively returning a piston to a preselected intermediate position.

Still more particularly, an object of this invention is to provide a three position fluid powered actuator including improved and simplified means of selecting the variable stroke length from the intermediate position of the piston.

These general objects as well as other and more specific objects of the invention will be fulfilled in the following description and claims, taken in conjunction with the attached drawings.

DESCRIPTION OF VIEWS

FIG. 1 is an end view of a cylinder which may be employed in practicing the principles of this invention.

FIG. 2 is a cross-sectional view taken along the line 2—2 of FIG. 1 showing the internal arrangement of the cylinder.

FIG. 3 is a cross-sectional view taken along the line 3—3 of FIG. 2.

FIG. 4 is a cross-sectional view taken along the line 4—4 of FIG. 2.

SUMMARY

The actuator disclosed herein includes a cylinder having a piston moved therein by fluid pressure applied to fluid passageways at the ends of the cylinder. A distinguishing feature of the actuator is the provision of a piston rod having a reduced diameter intermediate portion with followers slidably received on the intermediate portion. A preloaded spring extending between the followers is compressed when the piston is moved in either direction from the intermediate position. Thus the piston is always positively returned to a preselected intermediate position retained in the intermediate position by the preloaded spring when the fluid pressure differential across the piston is removed.

DETAILED DESCRIPTION

Referring to the drawings and first to FIG. 1, an end view of a preferred embodiment of an actuator is shown, the end view disclosing a first cylinder end 10. Extending through the cylinder end 10 is a piston rod portion 12D having a nut 14 thereon which may be a yoke or clevis by which the rod may be attached to a mechanism, such as a transmission gear shift, or the like.

FIG. 2 shows more details of the actuator and the internal arrangement. The actuator includes a cylinder including a first portion 16 and a cylinder second portion 18. The portions 16 and 18 are coaxial and are separated by an intermediate plate 28. The cylinder first portion 16 is closed by a cylinder second end 30.

The cylinder first and second portions 16 and 18, the intermediate plate 28 and the ends 10 and 30 are held in assembled relationship by means of rods 32 which extend through openings in the cylinder ends 10 and 30 through the intermediate plate 28. Rods 32 are retained by nuts 34.

Slidably and sealably positioned within the cylinder first portion 16 is a piston 36. Attached to the piston is a piston rod which, in this illustrated embodiment is formed of four portions, that is, a first portion 12A which is affixed to the piston 36, a reduced diameter intermediate portion 12B, a third full diameter portion 12C and threaded end portion 12D. The intermediate plate 28 has an opening 28A therein of a diameter larger than the piston rod portion 12A. In addition, intermediate plate 28 has fluid passageways 28B therein. The first cylinder end 10 has an opening 10A which slidably and sealably receives the piston rod portion 12C.

Formed in first cylinder end plate 10 is a first fluid passageway 38 which communicates between the exterior of the cylinder and the interior of cylinder second portion 18. Formed in the second cylinder end plate 30 is second fluid passageway 40 which communicates from the exterior of the actuator to the interior of the cylinder first portion 16 between the piston 36 and the second end plate 30. When fluid pressure at first fluid passageway 38 is greater than the fluid pressure at the second fluid passageway 40, the pressure forces piston 36 to move to the right in the direction towards second end plate 30. The fluid pressure flows from the interior of the cylinder second portion 18 through openings 28B in the intermediate plate 28 into cylinder portion 16. Contrarily, when the pressure is higher in passageway 40, force is applied against the piston 36 to move it in the direction towards the first end plate 10. To this extent, the piston 36 functions within the cylinder portion 16 in the normal manner of a double actuated hydraulic or pneumatic cylinder.

The piston rod intermediate portion 12B forms a first piston rod shoulder 42 and a second piston rod shoulder 44. Slidably received on the piston rod reduced diameter intermediate portion 12B is a first spring follower 46, which is adjacent the first shoulder 42 and, in like manner, a second spring follower 46 is adjacent shoulder 44. Compressibly extending between the followers 46 and 48 is a compression spring 50.

Slidably received on the piston rod first portion 12A between spring follower 46 and the intermediate plate 28 is a tubular first spacer 52 and, in like manner, slidably received on the piston rod portion 12C is a spacer 54 between the second spring follower 48 and first cylinder plate 10. Between the first spring follower 46 and the first spacer 52 is a calibrating washer 56 which is slidably received on the piston rod intermediate portion 12B. Also shown is a calibrating washer 56 between the second spring follower 48 and the second spacer 54. The use of calibrating washers 56 is optional.

While the actual structure employed may vary considerably from that described in practicing the invention, one means of assembly includes the arrangement wherein the piston rod 12C has a threaded opening 58 which receives a threaded extension 60 of the piston rod intermediate portion 12B. This permits the assembly of the spring followers 46, 48, spring 50, spacers 52, 54 and washers 56 onto the intermediate portion of the piston rod.

OPERATION

When fluid pressure is applied at passageway 38, the pressure is free to pass through openings 28B in the intermediate plate to apply force against piston 36, tending to move it in the direction towards second end plate 30. If the pressure at passageway 38 is greater than that of passageway 40, the piston 36 will be moved towards the right, that is, towards end plate 30. This will result in the piston rod moving in the direction towards the end plate 30. Since the spacer 52, washer 56 and follower 46 cannot move in such direction, the piston rod slides within these members. However, because of the shoulder 44 the follower 48 and washer 56 moves with the piston rod, thereby compressing spring 50. When the fluid pressure in passageway 38 is relieved, that is, when the pressure differential between first passageway 38 and second passageway 40 is removed, spring 50 forces the piston rod to the left until the follower 48 engages the spacer 54, or more precisely, until the washer 56 adjacent the follower engages the spacer 54. Thus the piston is returned to a positive preselected position when the fluid pressure is removed. The same thing happens when the pressure at passageway 40 exceeds that at passageway 38. The piston and piston rod are moved to the left, moving with it the followers 46 thereby compressing spring 50.

By means of washers 56 the exact length of stroke of the piston 36 from the intermediate position can be selected. In the illustrated arrangement a washer 56 is utilized adjacent each follower. It can be seen that no washers may be employed or any number may be employed, adjacent followers 46 or follower 48. By positioning the selected number and thicknesses of washers 56 adjacent the selected followers 46 or 48, the precise length of the stroke from the intermediate position is selected.

The degree of fluid pressure differential required to move the piston away from its intermediate position depends upon the force of spring 50. Naturally, the more compressive force imparted by spring 50, the more pressure differential is required to move the piston from its intermediate position.

It can be seen that the intermediate plate 28 may be provided with a gasket or sealing means in opening 28A and with opening 28B closed in such arrangement the first fluid passageway 38 could be placed in the intermediate plate.

In this event, the actuator functions in the same way except that no fluid pressure need be retained within the second cylinder portion 18 and in which event this portion serves only as a support for the first cylinder end plate 10 which becomes only a positioning plate, not required to retain fluid pressure. This difference suggests the great variety of different physical embodiments which may be employed in practicing the invention.

The function of spacer 52 is to allow travel of the piston rod such that the full diameter first portion 12A is always received in the opening 28A of the intermediate plate and in like manner, the full diameter of piston rod portion 12C is always received in the opening 10A of the first cylinder end plate, insuring sealing of the piston rod.

While the invention has been described with a great degree of particularity, it is manifest that many changes may be made in the details of construction and components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A three position fluid actuator comprising:

a cylinder having a first end plate and a second end plate, the first end plate having an axial opening therein and the cylinder having an intermediate plate having an axial opening therein;

a piston reciprocally positioned within said cylinder and between the intermediate plate and said second end plate;

a piston rod affixed coaxially to said piston and reciprocally extending through said opening in said intermediate plate and sealably through said opening in said first cylinder end plate, said cylinder having a first fluid passage in said first end plate and a second fluid passageway in said second end plate whereby when fluid pressure in said first passageway is greater than in said second passageway, said piston tends to move toward said second cylinder end plate and vice versa, fluid moving between said first passageway through said fluid passages in said intermediate plate;

a piston rod having a reduced diameter portion intermediate said first cylinder end plate and said intermediate plate, the reduced diameter portion forming spaced shoulders on said piston rod;

a pair of spring followers slidably received on said piston rod reduced diameter portion, the followers engaging said piston rod shoulders;

tubular spacers received on said piston rod, one such spacer being positioned between said cylinder first end plate and one of said followers and the other said spacer being slidably received on said piston rod between said intermediate plate and said other of said followers;

a spring compressibly extending between said followers urging said followers into contact with said spacers to normally and positively position the piston in an intermediate position, said piston being movable away from said intermediate position when the fluid pressure of one of said fluid passageways exceeds the fluid passage in the other of said fluid passageways, the spring returning the piston to said intermediate position when differential fluid pressure on said piston is removed; and washers, each having an axial opening therein, each washer slidably receiving a portion of said reduced diameter portion between said spacers and said adjacent followers, the thickness of the washers providing means of selecting the length of stroke of the piston from its intermediate position.

* * * * *